US008820900B2

(12) United States Patent
Kobayashi

(10) Patent No.: US 8,820,900 B2
(45) Date of Patent: Sep. 2, 2014

(54) LIQUID EJECTION HEAD AND LIQUID EJECTION APPARATUS

(75) Inventor: Yutaka Kobayashi, Shiojiri (JP)

(73) Assignee: Seiko Epson Corporation (JP)

( * ) Notice: Subject to any disclaimer, the term of this patent is extended or adjusted under 35 U.S.C. 154(b) by 5 days.

(21) Appl. No.: 13/438,419

(22) Filed: Apr. 3, 2012

(65) Prior Publication Data

US 2012/0256985 A1 Oct. 11, 2012

(30) Foreign Application Priority Data

Apr. 5, 2011 (JP) ..... 2011-083391

(51) Int. Cl.
*B41J 2/175* (2006.01)

(52) U.S. Cl.
USPC ..... 347/85; 347/84; 347/86

(58) Field of Classification Search
CPC ..... B41J 2/17563; B41J 2002/14403; B41J 2/055; B41J 2/17556
See application file for complete search history.

(56) References Cited

U.S. PATENT DOCUMENTS

| | | | | |
|---|---|---|---|---|
| 6,361,159 | B1 * | 3/2002 | Chino | 347/86 |
| 8,033,659 | B2 | 10/2011 | Kobayashi | |
| 2002/0036671 | A1 * | 3/2002 | Takahashi et al. | 347/29 |
| 2011/0128313 | A1 * | 6/2011 | Matoba | 347/6 |
| 2012/0038721 | A1 * | 2/2012 | Yokouchi | 347/93 |

FOREIGN PATENT DOCUMENTS

| | | |
|---|---|---|
| JP | 2008-162217 | 7/2008 |
| JP | 2008-173961 | 7/2008 |
| JP | 2010-036481 A | 2/2010 |

* cited by examiner

*Primary Examiner* — Justin Seo
(74) *Attorney, Agent, or Firm* — Harness, Dickey & Pierce, P.L.C.

(57) ABSTRACT

A liquid ejection head includes a downstream filter chamber that is disposed at an inlet opening of an ink introduction path and is provided with a filter disposed therein, and a flexible film that is disposed on an inner wall of the filter chamber at a position downstream of the filter, wherein the flexible film is configured to deform in accordance with the pressure changes in the flow channel.

8 Claims, 6 Drawing Sheets

LIQUID EJECTION HEAD AND LIQUID EJECTION APPARATUS

BACKGROUND

1. Technical Field

The present invention relates to a liquid ejection head such as an ink jet recording head and a liquid ejection apparatus having the same, and more specifically to a liquid ejection head that introduces a liquid from a liquid containing member into a pressure chamber and ejects the liquid from the pressure chamber through nozzles by driving a pressure generating unit, and a liquid ejection apparatus having the same.

2. Related Art

Liquid ejection apparatuses generally have a liquid ejection head and are configured to eject various liquid from the ejection head. Such liquid ejection apparatuses include, for example, image recording apparatuses such as an ink jet printer and an ink jet plotter. Recently, liquid ejection apparatuses are applied to various manufacturing apparatuses by taking advantage of ability to precisely eject an extremely small amount of liquid onto a predetermined position. For example, liquid ejection apparatuses are applied to display manufacturing apparatuses for manufacturing color filters of liquid crystal displays, electrode manufacturing apparatuses for manufacturing electrodes of organic EL (electroluminescence) displays or FEDs (field emission displays), and chip manufacturing apparatuses for manufacturing biochips (biochemical chips). Further, the recording head for image recording apparatuses ejects ink in a liquid form, and the color material ejection head for display manufacturing apparatuses ejects the respective color material solution of R (Red), G (Green) and B (Blue). The electrode material ejection head for electrode manufacturing apparatuses ejects an electrode material in a liquid form, and the bio-organic material ejection head for chip manufacturing apparatuses ejects a bio-organic solution.

Liquid ejection apparatuses of the above-mentioned type have been developed as the apparatuses that use a cartridge-type liquid containing member, which is easily distributed and handled. For example, ink jet printers (hereinafter, simply referred to as printers) that use ink cartridges for containing ink in a liquid form are widely available. In a printer of this configuration, when ink cartridges are loaded in a recording head which is a type of liquid ejection head, ink introduction needles (liquid introduction needles) of the recording head are inserted into the respective ink cartridges, thereby allowing ink to be introduced from the ink cartridges into the recording head through ink introduction holes (liquid introduction holes) that are formed at the tip end of the ink introduction needles. The ink which has been introduced into the recording head is then introduced into common liquid chambers (also referred to as reservoirs or manifolds) via introduction paths in the recording head. The ink which has been introduced into the common liquid chambers is then supplied to a plurality of pressure chambers that communicate with the common liquid chambers. Then, piezoelectric transducers or heat generating elements which are a type of pressure generating unit are driven to generate pressure changes in the pressure chambers. The ink droplets are ejected through nozzles that communicate with the pressure chambers by controlling the pressure changes in the pressure chambers.

In some cases, an excessive positive pressure or negative pressure may be created in the ink cartridge due to fluctuation of temperature or atmospheric pressure, and when such pressure is transmitted from the ink cartridge to the nozzles of the recording head, menisci formed at the nozzles may be broken.

That is, a meniscus may be excessively withdrawn into the pressure chamber from the inner rim of the nozzle, or alternatively, may outwardly expand from the nozzle opening on the ejection side. When the pressure of the meniscus is beyond the level of pressure resistance, the meniscus may not be appropriately formed, that is, the meniscus may be broken, thereby leading to a failure of ink ejection, so-called missing dots. Further, there is a risk that ink may leak from the nozzles. In order to overcome such problems, JP-A-2008-162217 discloses providing a pressure control valve on the ink cartridge (ink tank) that is capable of allowing the air layer in the cartridge to be open to the atmosphere, so that variation in pressure in the ink cartridge is reduced by opening the pressure control valve when an excessive pressure is generated in the ink cartridge due to fluctuation of temperature or the like.

In the above-mentioned configuration in which air layer is open to the atmosphere by using a pressure control valve, relatively small pressure changes, such as those due to fluctuation of temperature or atmospheric pressure, can be accommodated. However, it may not be possible to adequately address more instantaneous fluctuations of pressure, for example, the case where an impact such as an external force is applied to the ink cartridge during the exchange of ink cartridges, or where the relative positions of the ink cartridge and the recording head are changed due to any vibration.

The situation such as those described above may occur not only in the exemplified ink jet recording apparatus, but also in other liquid ejection apparatuses that are configured to introduce a liquid from the liquid containing member into the liquid ejection head.

SUMMARY

An advantage of some aspects of the invention is that a liquid ejection head that is capable of reliably reducing pressure changes in the flow channels, and a liquid ejection apparatus having the same are provided.

According to an aspect of the invention, a liquid ejection head that introduces a supplied liquid into a common liquid chamber through a filter and a liquid introduction path and generate pressure changes in a pressure chamber that communicates with the common liquid chamber by actuating a pressure generating unit, so that the liquid in the pressure chamber are ejected as liquid droplets through nozzles by using the pressure changes, includes a filter chamber that is disposed at an inlet opening of the liquid introduction path and is provided with the filter disposed therein, the diameter of the filter chamber increasing from the liquid introduction path, and a flexible film that is disposed on an inner wall of the filter chamber at a position downstream of the filter, wherein the flexible film is configured to deform in accordance with the pressure changes in the liquid introduction path.

Accordingly, since the flexible film in the filter chamber deforms in accordance with the pressure changes in the liquid introduction path so as to reduce the pressure changes in the liquid introduction path, it is possible to prevent the pressure changes from being transmitted to the nozzles and reduce adverse effects to the menisci formed at the nozzles. Further, in this configuration, since the pressure changes is absorbed by the deformation of the flexible film disposed at a position downstream of the filter, the transmission of pressure changes to the nozzles can be more effectively reduced, compared with the configuration in which the pressure changes is absorbed at a position upstream of the filter. In addition, it is also possible to address more rapid pressure changes, compared with the conventional configuration in which an impact is reduced by using a pressure control valve to allow the air layer to be open to the atmosphere.

Further, in the above configuration, it is desirable that an adjustment mechanism is provided so as to maintain the amount of gas in the pressure chamber to be in a predetermined range.

In the above aspect of the invention, a cavity can be formed on the inner wall of the filter chamber at a position downstream of the filter so as to be recessed away from the filter chamber, and the flexible film can be formed so as to seal the opening of the cavity.

Accordingly, since the cavity provides a deformation margin of the flexible film, it is possible to absorb the pressure changes in a more reliable manner without interfering with the deformation of the flexible film.

In the above aspect of the invention, it is desirable that the cavity is configured to be open to the atmosphere.

Accordingly, since the flexible film smoothly deforms, it is possible to absorb the pressure changes in a more effective manner.

In the above aspect of the invention, it is desirable that an upstream flexible film is disposed on the inner wall of the filter chamber at a position upstream of the filter.

Accordingly, since the pressure changes in the liquid ejection head is absorbed by means of deformation of the flexible films that are disposed above and below the filter, it is possible to more reliably reduce adverse effects to the menisci at the nozzles.

According to another aspect of the invention, a liquid ejection apparatus includes any one of the above liquid ejection head, a sealing member that seals a nozzle forming surface of the liquid ejection head, and a suction unit that suctions a liquid out of the nozzles by generating negative pressure in a sealed cavity that is formed between the sealing member and the nozzle forming surface.

Accordingly, in addition to the fact that the pressure changes in the liquid ejection head can be absorbed by using the flexible films, it is possible to generate negative pressure in the sealed cavity that is formed between the sealing member and the nozzle forming surface by means of the suction unit, thereby improving the ability to discharge air bubbles during cleaning operation by suctioning the liquid out of the nozzles. Accordingly, the reliability of the liquid ejection apparatus can be improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of the invention will be described below with reference to the attached drawings. Although various limitations are made as preferred examples of the invention in the following embodiment, the invention is not limited thereto unless otherwise specifically described herein. In the following description, ink jet recording apparatus (hereinafter, referred to as printer) will be described as an example of a liquid ejection apparatus of the invention.

Figure 1:
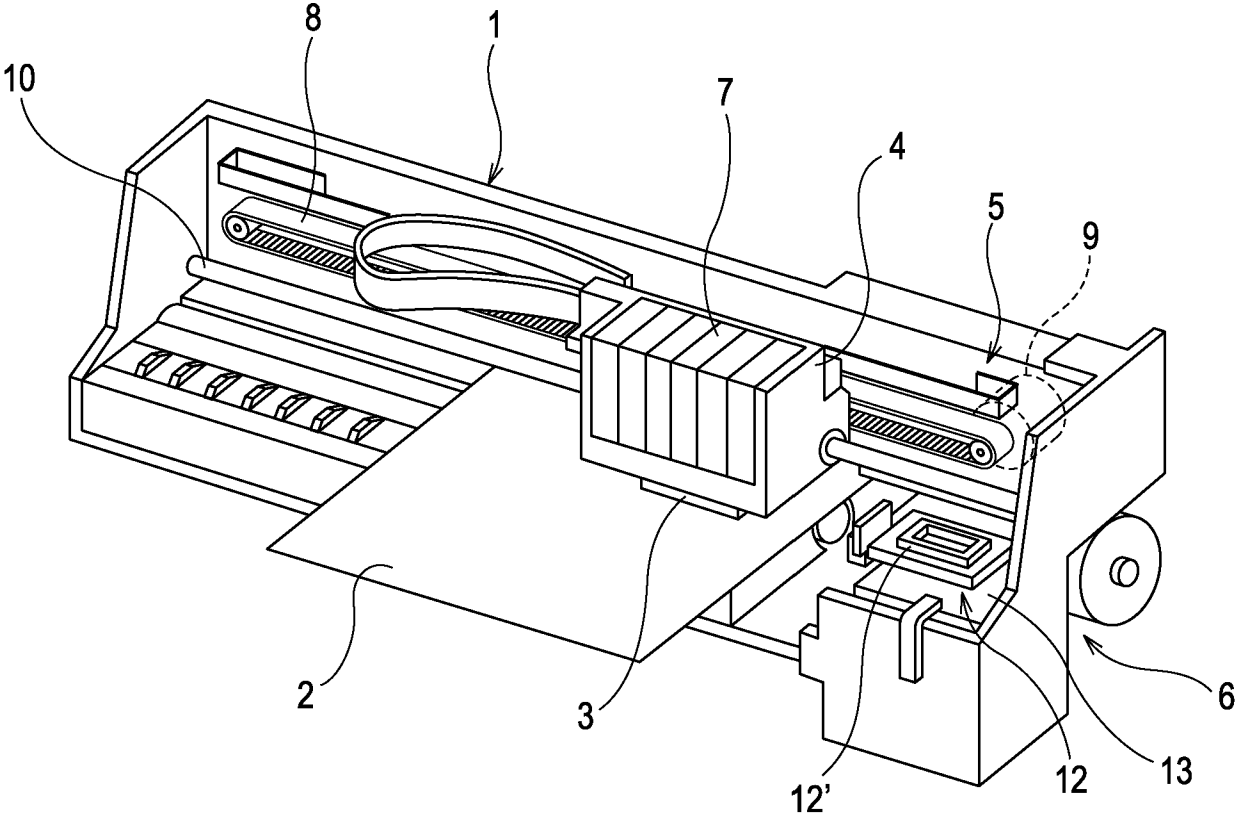
FIG. 1 is a perspective view showing a configuration of a printer.

First, a schematic configuration of an ink jet recording apparatus (a type of liquid ejection apparatus; hereinafter, referred to as printer) that includes a recording head will be described below with reference to FIG. 1. The exemplified printer 1 is a device that performs recording of images and the like by ejecting ink in a liquid form onto the surface of a recording medium (ejection target) 2 such as a recording sheet. The printer 1 includes a recording head 3, a carriage 4 on which the recording head 3 is mounted, a carriage movement mechanism 5 that reciprocates the carriage 4 in a main scan direction, and a sheet feeding mechanism 6 that feeds the recording medium 2 in a sub-scan direction (a direction perpendicular to the main scan direction). The above-mentioned ink is a type of liquid of the invention and is contained in ink cartridges 7 (a type of liquid containing members). The ink cartridges 7 are detachably mounted on the recording head 3 and each ink cartridge 7 contains different color of ink in this embodiment.

The carriage movement mechanism 5 is provided with a timing belt 8. The timing belt 8 is driven by a pulse motor 9 such as a DC motor. When the pulse motor 9 is actuated, the carriage 4 reciprocates in the main scan direction (a width direction of the recording sheet 2) while being guided by a guide rod 10 which is disposed on the printer 1.

A capping mechanism 12 is positioned at a home position which is a non-recording area of the printer 1. The capping mechanism 12 includes a cap member 12' in a tray shape (a type of sealing member of the invention) that can abut against a nozzle forming surface of the recording head 3. In the capping mechanism 12, the cap member 12' has an inner space that serves as a sealed cavity and is configured to be closely attachable to the nozzle forming surface with nozzles 46 of the recording head 3 facing to the sealed cavity (see FIGS. 2 and 3). Further, a pump unit 13 (a type of suction unit of the invention) which is connected to the capping mechanism 12 can be actuated to generate negative pressure in the sealed cavity. When the pump unit 13 is actuated to generates negative pressure in the sealed cavity (sealed space) while the cap member 12' is in close contact with the nozzle forming surface, ink and air bubbles in the recording head 3 are suctioned and discharged into the sealed cavity of the cap member 12' through the nozzles 46. That is, the capping mechanism 12 performs cleaning to purge ink and air bubbles contained in the recording head 3 (in the ink flow channels).

Figure 2:
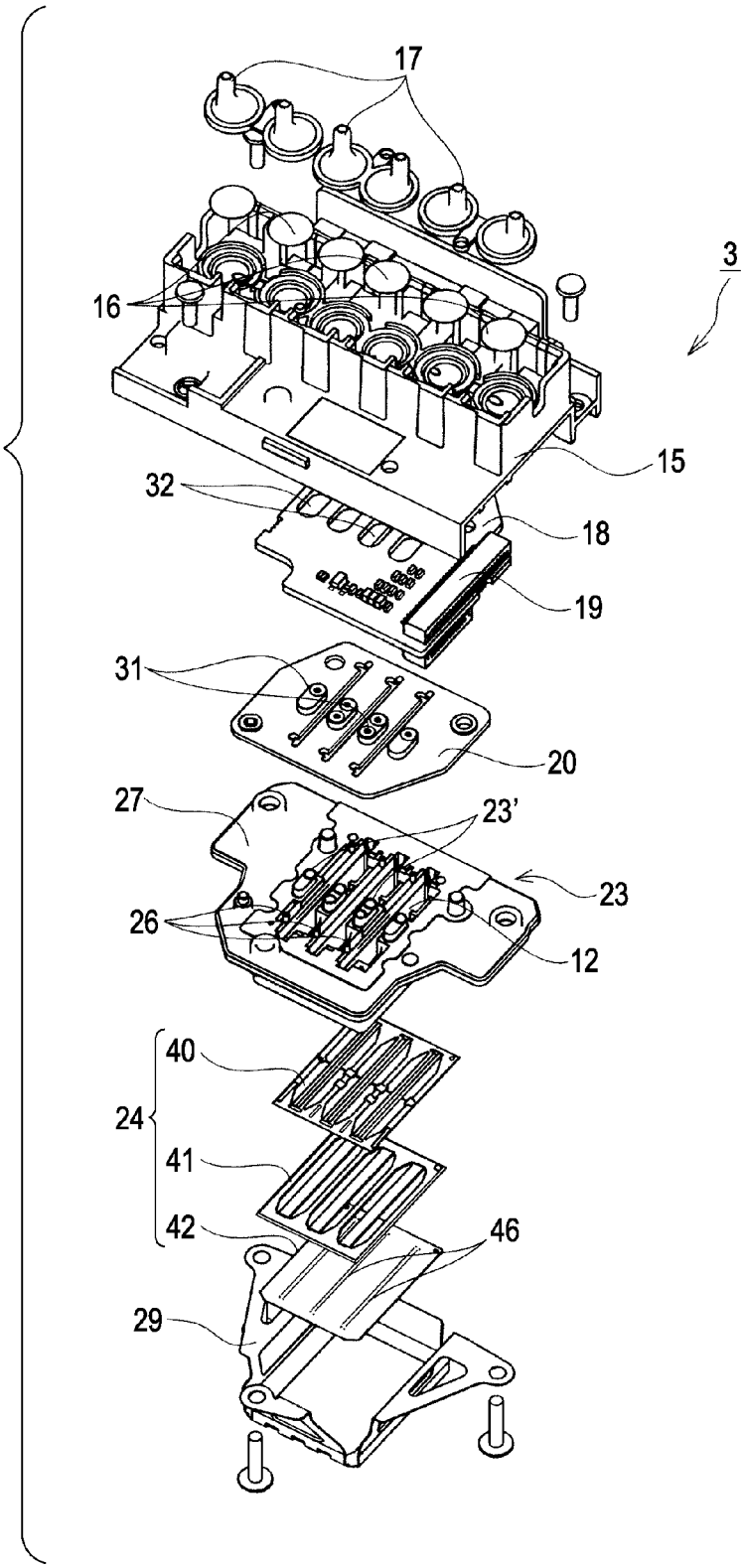
FIG. 2 is an exploded perspective view showing a configuration of a recording head.
Figure 3:
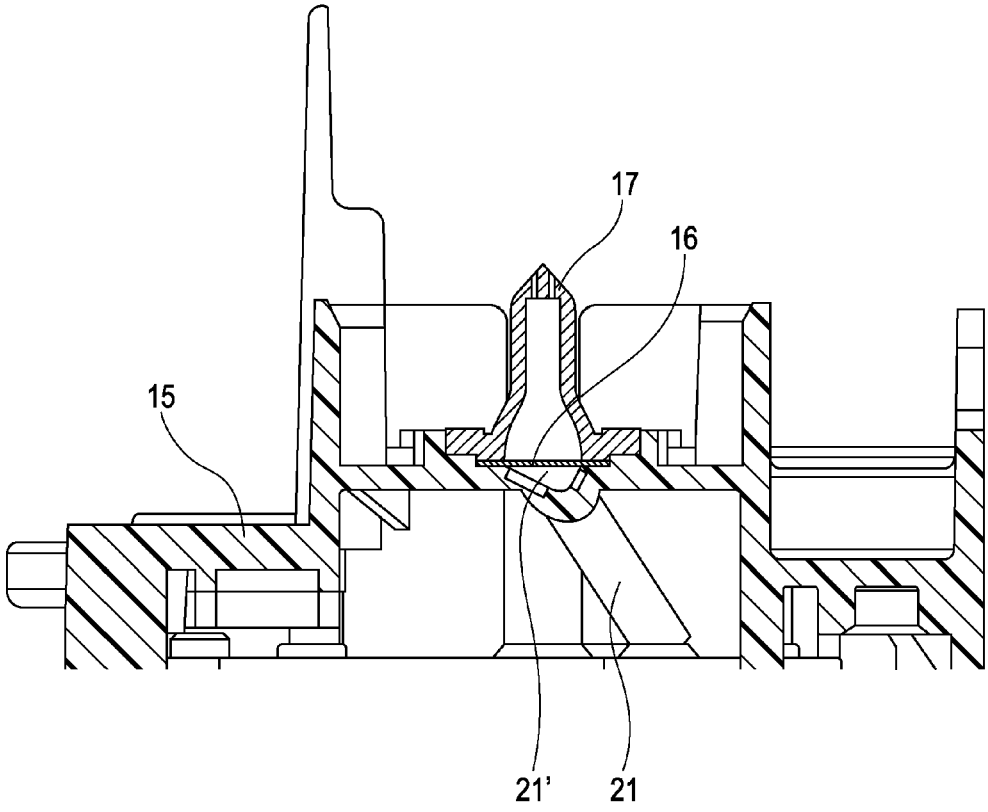
FIG. 3 is a sectional view showing a configuration of an introduction needle unit.
Figure 4:
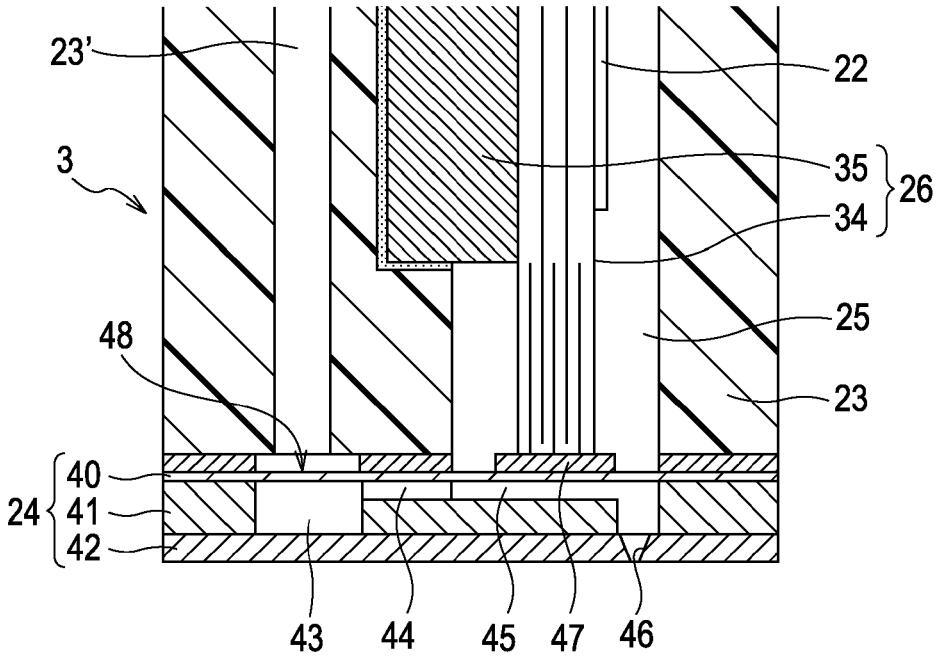
FIG. 4 is an essential sectional view showing a configuration of the recording head.

Next, a configuration of the recording head 3 will be described below. FIG. 2 is an exploded perspective view showing a configuration of the recording head 3, FIG. 3 is a sectional view of an introduction needle unit 15, and FIG. 4 is an essential sectional view of the recording head 3. The exemplified recording head 3 includes the introduction needle unit 15, a drive substrate 18, a seal member 20, a headcase 23 and a flow channel unit 24 and transducer units 26.

The introduction needle unit 15 is made of, for example, a synthetic resin such as epoxy-based resin. A plurality of ink introduction needles 17 (which correspond to liquid introduction needles of the invention) are disposed on the upper surface of the introduction needle unit 15 with filters 16 interposed therebetween. These ink introduction needles 17 are configured such that the ink cartridges 7 are detachably mounted thereon. Further, introduction tubes 21 are formed in the introduction needle unit 15 so as to correspond to the respective ink introduction needles 17. The inside of the introduction tube 21 serves as an ink introduction path 21' (a type of liquid introduction path of the invention). The upper end of the ink introduction path 21' communicates with a needle flow channel 51 of the ink introduction needle 17 via the filter 16, while the lower end of the ink introduction path 21' communicates with a case flow channel 23' that is formed in the headcase 23 via a flow channel joint section 31 of the seal member 20.

The drive substrate 18 receives drive signals and the like from the printer body, which is not shown, and transmits the received drive signals to piezoelectric transducers 34 via a flexible cable 22. The drive substrate 18 has electronic components mounted thereon, such as a connector 19 and a drive IC. The connector 19 is connected to wiring members such as FFC (flexible flat cable), and the drive substrate 18 receives drive signals from the printer body via the FFC. Further, clearance holes 32 are formed on the drive substrate 18 at positions corresponding to the flow channel joint sections 31 of the seal member 20 so that the flow channel joint sections 31 are inserted therethrough. The drive substrate 18 is disposed on the proximal side 27 of the headcase 23 with the seal member 20 interposed therebetween.

The seal member 20 is a plate shaped member made of an elastic material such as an elastomer and a rubber, and disposed between the proximal side 27 of the headcase 23 and the drive substrate 18. The flow channel joint sections 31 are raised on the seal member 20 at positions corresponding to the case flow channels 23' and the ink introduction paths 21' in the introduction needle unit 15. The flow channel joint sections 31 are disposed between the ink introduction paths 21' and the case flow channels 23' such that the ink introduction paths 21' and the case flow channels 23' communicate with each other in a liquid-tight manner.

The headcase 23 is a hollow box-shaped member made of a synthetic resin and is connected to the flow channel unit 24 on the distal side (underside) thereof which is opposite to the proximal side 27. Further, the headcase 23 accommodates the transducer units 26 in accommodation cavities 25 which are formed therein, and is connected to the introduction needle unit 15 on the proximal side 27 thereof which is opposite to the flow channel unit 24 with the seal member 20 and the drive substrate 18 interposed therebetween. The case flow channels 23' are formed so as to extend through the headcase 23 in the height direction. The upper end of the case flow channels 23' are open on the proximal side 27 and communicate with the ink introduction paths 21' of the introduction needle unit 15 via the flow channel joint sections 31 of the seal member 20. Further, the lower end of the case flow channels 23' communicate with a common ink chambers 43 in the flow channel unit 24. Accordingly, ink is introduced from the ink introduction needles 17 and supplied to the common ink chambers 43 through the ink introduction paths 21' and the case flow channels 23'.

Moreover, a head cover 29 made of a thin metal plate is attached to the distal side of the headcase 23 so as to enclose the outer periphery of the flow channel unit 24. The head cover 29 protects the side faces of the flow channel unit 24 and the headcase 23 and also serves to ground a nozzle forming substrate 42 of the flow channel unit 24, thereby preventing problems such as noise caused by static electrical charges from the recording sheets or the like.

The transducer unit 26 includes a plurality of piezoelectric transducers 34 (a type of pressure generating unit) arranged in a comb-like pattern and a fixation plate 35 affixed to the piezoelectric transducers 34. Each piezoelectric transducer 34 has the fixation end that is affixed to the fixation plate 35 and the free end that extends outward from the distal side of the fixation plate 35. That is, each piezoelectric transducer 34 is mounted on the fixation plate 35 in a so-called cantilever fashion. The fixation plate 35 that supports the piezoelectric transducers 34 is formed of, for example, a stainless steel having a thickness of approximately 1 mm. The transducer unit 26 is accommodated and secured in the accommodation cavity 25 by bonding the back surface of the fixation plate 35 to a case inner wall that segments the accommodation cavity 25.

The flexible cable 22 is formed, for example, by fabricating a conductor pattern of a copper foil on the surface of a base film made of polyimide, and coating the conductor pattern with a resist. One terminal end (not shown in the figure) is formed at one end of the flexible cable 22 so as to be electrically connected to the terminals of the piezoelectric transducers 34, while the other terminals end (not shown in the figure) is formed at the other end of the flexible cable 22 so as to be electrically connected to the terminals of the drive substrate 18. The flexible cable 22 is accommodated in the accommodation cavity 25 with one end thereof being electrically connected to the terminals of the piezoelectric transducer 34. Further, the other end of the flexible cable 22 is drawn out of the accommodation cavity 25 and is electrically connected to the terminals of the drive substrate 18.

As shown in FIG. 4, the flow channel unit 24 is formed from flow channel unit components composed of a sealing plate (vibration plate) 40, a flow channel forming substrate 41 and the nozzle forming substrate 42 which are laminated and bonded together with adhesive so as to form a unitary assembly. The flow channel unit 24 is a member that forms a series of ink flow channels (which corresponds to liquid flow channels of the invention) that extends from the common ink chambers 43 (common liquid chambers) to the nozzles 46 via ink supply ports 44 and pressure chambers 45. The pressure chambers 45 are formed as elongated chambers that extend in a direction perpendicular to the array direction of nozzles 46 (nozzle row direction). The common ink chambers 43 communicate with the case flow channels 23' so that ink is introduced from the ink introduction needles 17. The ink introduced from the common ink chambers 43 is distributed to the respective pressure chambers 45 via the ink supply ports 44.

The nozzle forming substrate 42 which is positioned at the bottom of the flow channel unit 24 is a thin metal plate in which rows of a plurality of nozzles 46 are formed at a pitch that corresponds to the dot forming density (for example, 180 dpi). The nozzle forming substrate 42 according to this embodiment is formed of a stainless steel plate in which a plurality of rows of the nozzles 46 are formed in a scan direction of the recording head 3.

The flow channel forming substrate 41 is a plate-shaped member disposed between the nozzle forming substrate 42 and the sealing plate 40 and has flow channel sections which serve as ink flow channel sections formed therein. Specifically, the partitioned cavities are formed as the common ink chambers 43, the ink supply ports 44 and the pressure chambers 45. In this embodiment, the flow channel forming substrate 41 is fabricated by anisotropic etching a silicon wafer which is a base material having a crystalline structure.

The sealing plate 40 disposed on the upper surface of the flow channel forming substrate 41 which is opposite to the nozzle forming substrate 42 is a double-structured composite plate that is formed by laminating an elastic film on a support plate made of a metal such as a stainless steel. Islands 47 are formed on the sealing plate 40 at positions which correspond to the pressure chambers 45 by removing the support plate in annular shape, for example by etching, and are joined to the distal free ends of the piezoelectric transducers 34 so as to serve as diaphragm sections. That is, the sealing plate 40 is configured such that the elastic film around the islands 47 elastically deforms in response to actuation of the piezoelectric transducers 34. Further, the sealing plate 40 seals one side of the opening of the flow channel forming substrate 41 and also serves as compliance sections 48. The portions of the sealing plate 40 that correspond to the compliance sections 48 are formed of the elastic film only by removing the support plate, for example by etching, in the similar manner to forming the diaphragm sections.

When drive signals are applied from the drive substrate 18 to the piezoelectric transducers 34 via the flexible cable 22 in the recording head 3, the piezoelectric transducers 34 expand or contract in the longitudinal direction of the component, thereby moving the islands 47 in the direction toward or away from the pressure chambers 45. As a consequence, the volume of the pressure chambers 45 varies, thereby causing pressure changes of ink in the pressure chambers 45. Accordingly, ink droplets (a type of liquid droplets) are ejected from the nozzles 46 by controlling the pressure changes.

Figure 5A:
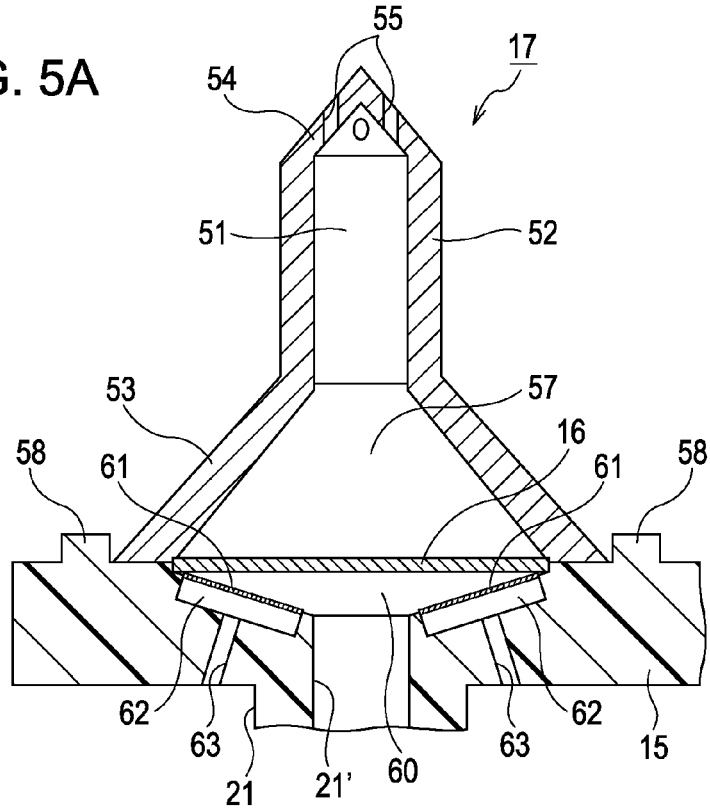
FIGS. 5A and 5B are essential sectional views showing a configuration of an ink introduction needle and an introduction needle unit.
Figure 5B:
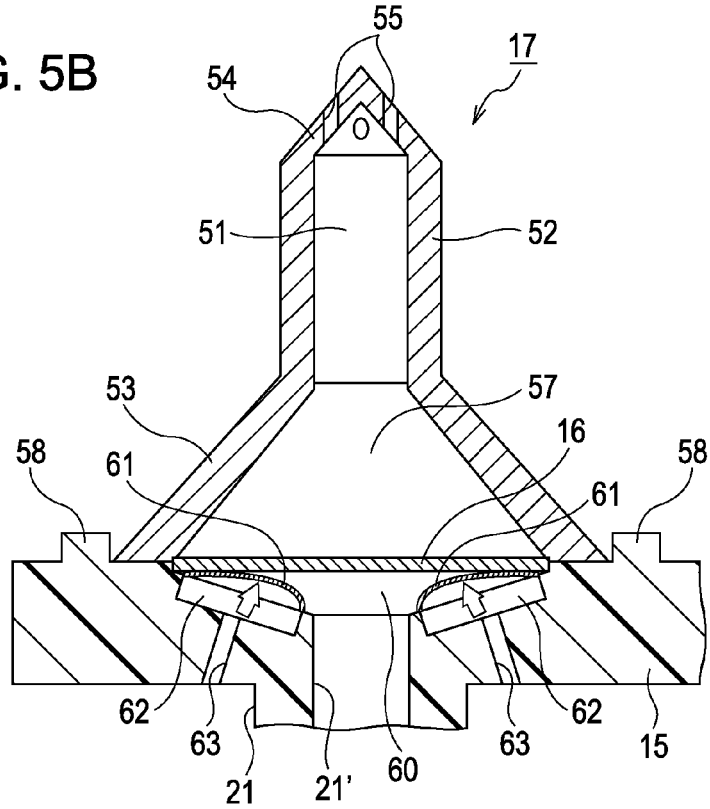

Next, a configuration of the ink introduction needle 17 will be described below. FIGS. 5A and 5B are essential sectional views showing a configuration of a portion of the ink introduction needle 17 and the introduction needle unit 15. The ink introduction needle 17 is a hollow needle-shaped member and has an inner space which serves as the needle flow channel 51. The ink introduction needle 17 is made of a material such as a synthetic resin. The ink introduction needle 17 includes a cylindrical section 52 having a constant inner diameter and an expanded diameter section 53 whose inner diameter increases from the upstream end to the downstream end.

The cylindrical section 52 is a portion that is inserted into the ink cartridge 7 and an apex 54 in a tapered cone shape is formed at the tip end of the cylindrical section 52. In the apex 54, a plurality of ink introduction holes 55 (which correspond to liquid introduction holes of the invention) are formed so as to communicate the outside of the ink introduction needle 17 and the needle flow channel 51. That is, as described above, when the cylindrical section 52 is inserted into the ink cartridge 7, ink in the cartridge is introduced into the needle flow channel 51 through the ink introduction holes 55. The expanded diameter section 53 is formed continuously from the cylindrical section 52 at a position downstream of the cylindrical section 52 and is configured substantially in a cone shape whose diameter gradually increases from the upstream end (the side of the cylindrical section 52) to the downstream end (the side of the introduction needle unit 15). The inner space of the expanded diameter section 53 serves as part of the needle flow channel 51 and also as an upstream area of a filter chamber 57.

An introduction needle placement frame 58 is formed on the surface of the introduction needle unit 15 at a position where the ink introduction needle 17 is placed, that is, at the periphery of the inlet opening of the ink introduction path 21'. The introduction needle placement frame 58 is formed on the upper surface of the introduction needle unit 15 in a bank shape so as to position the ink introduction needle 17. When the ink introduction needle 17 is positioned inside the introduction needle placement frame 58, the lower end of the expanded diameter section 53 of the ink introduction needle 17 is enclosed by the introduction needle placement frame 58. Further, a downstream filter chamber 60 (which corresponds to a filter chamber of the invention) is formed at the inlet opening of the ink introduction path 21'. The downstream filter chamber 60 is formed to have a diameter that is gradually increases from the ink introduction path 21' toward the inlet opening and serves as part of the ink introduction path 21'. The surface area of the inlet opening of the downstream filter chamber 60 corresponds to the surface area of the opening of the expanded diameter section 53 of the ink introduction needle 17. The filter 16 is disposed to close the inlet opening of the downstream filter chamber 60. The filter 16 is formed of, for example, a metal mesh that is finely braided and filers ink supplied from the ink cartridge 7.

A cavity 62 is formed on the inner wall of the downstream filter chamber 60 at a position downstream of the filter so as to be recessed in the direction of the wall thickness. Further, the opening of the cavity 62 on the side of the downstream filter chamber 60 is sealed with a flexible film 61. The flexible film 61 is formed of a thin film of resin or metal having air-tight and liquid-tight properties. Accordingly, liquid (ink) or gas is not allowed to flow from the downstream filter chamber 60 to the cavity 62 or from the cavity 62 to the downstream filter chamber 60. Further, an open-to-atmosphere path 63 is formed with one end thereof being open on the side of the cavity 62 of this embodiment which is opposite to the flexible film 61. The open-to-atmosphere path 63 is formed to penetrate through the structure wall of the introduction needle unit 15 such that the inside of the cavity 62 is open to the outside.

The ink introduction needle 17 is mounted within the introduction needle placement frame 58 of the introduction needle unit 15 for example by ultrasound welding while the lower opening of the expanded diameter section 53 faces to the filter 16 that is positioned at the inlet opening of the downstream filter chamber 60. As a consequence, the needle flow channel 51 of the ink introduction needle 17 communicates with the ink introduction path 21' via the filter 16 in a liquid-tight manner.

The recording head 3 according to the invention has a feature that the pressure changes of ink in the flow channel is absorbed by using the flexible film 61 disposed in the downstream filter chamber 60. That is, when an impact is applied to the ink cartridge 7 such as during the exchange of ink cartridges 7 and the pressure of ink in the flow channels of the recording head 3 rapidly changes, the pressure changes is absorbed by the flexible film 61 deforming in accordance with the pressure changes. That is, the flexible film 61 deforms toward the cavity 62 if the pressure in the flow channels of the recording head 3 becomes higher than usual, or alternatively, the flexible film 61 deforms toward the downstream filter chamber 60 if the pressure in the flow channels of the recording head 3 becomes lower than usual, thereby reducing variation in pressure. As a result, it is possible to prevent the pressure changes from being transmitted to the nozzles 46 and reduce adverse effects to the menisci formed at the nozzles 46.

Moreover, since the recording head 3 is configured such that the pressure changes is absorbed by the deformation of the flexible film 61 disposed at a position downstream of the filter 16, the transmission of pressure changes to the nozzles 46 can be more effectively reduced, compared with the configuration in which the pressure changes is absorbed at a position upstream of the filter 16. In addition, it is also possible to address more rapid pressure changes, compared with the conventional configuration in which an impact is reduced by using a pressure control valve to allow the air layer to be open to the atmosphere. Further, since the cavity 62 is provided in this embodiment, thereby ensuring a deformation margin of the flexible film, it is possible to absorb the pressure changes in a more reliable manner without interfering with the deformation of the flexible film. Moreover, since the cavity 62 is configured to be open to the atmosphere, thereby promoting smooth deformation of the flexible film 61, it is possible to absorb the pressure changes in a more effective manner.

When the ink introduction needle 17 is inserted into and removed from the ink cartridge 7, sometimes air (air bubbles) may be contained in the needle flow channel 51. While the air bubbles are collected in the upstream filter chamber 57 by the filter 16, the air bubbles are connected with each other and become larger. The printer 1 performs cleaning operation on a regular basis by using the capping mechanism 12 so that the air bubbles collected in the expanded diameter section 53 are discharged.

In the cleaning operation, the pump unit 13 is actuated while the cap member 12' is in close contact with the nozzle forming surface to generate an ink flow through the ink flow channels at the speed several times faster than usual recording operation. The air bubbles in the upstream filter chamber 57 flows with the ink flow and are discharged to the outside of the recording head through the nozzles 46. The suctioning conditions of the pump unit 13 (the suctioning force, the duration of suctioning) are determined depending on the ability to discharge air bubbles.

When negative pressure is generated in the flow channel during cleaning operation to discharge air bubbles, the flexible film 61 of the downstream filter chamber 60 deforms toward the downstream filter chamber 60 as shown in FIG. 5B, thereby narrowing the flow channel (decreasing the surface area of the flow channel). This increases the speed of ink flow and promotes air bubbles to pass through the filter 16, which makes it possible to discharge air bubbles in a more effective manner and in a shorter period of time than before. As a result, the amount of ink consumed in one cleaning operation can be reduced. Accordingly, the printer 1 according to the invention can absorb the rapid pressure changes by using the flexible films 61 provided in the downstream filter chamber 60, and also improve the ability to discharge air bubbles during cleaning operation. Therefore, it is possible to improve the reliability of the printer.

It should be noted that the invention is not limited to the above-mentioned embodiments, and various modifications are possible within the scope of the invention as defined in the following claims.

For example, although the cavity 62 is described as being open to the atmosphere by the open-to-atmosphere path 63 in the above embodiment, the configuration is not limited to the above embodiment and the cavity 62 may not be open to the atmosphere by the open-to-atmosphere path 63. In this case, the volume of air layer in the cavity 62 decreases or increases in accordance with a pressure applied to the flexible film 61, thereby allowing the pressure changes to be absorbed. Further, the flexible film 61 may be also configured to be exposed to the outside.

Figure 6:
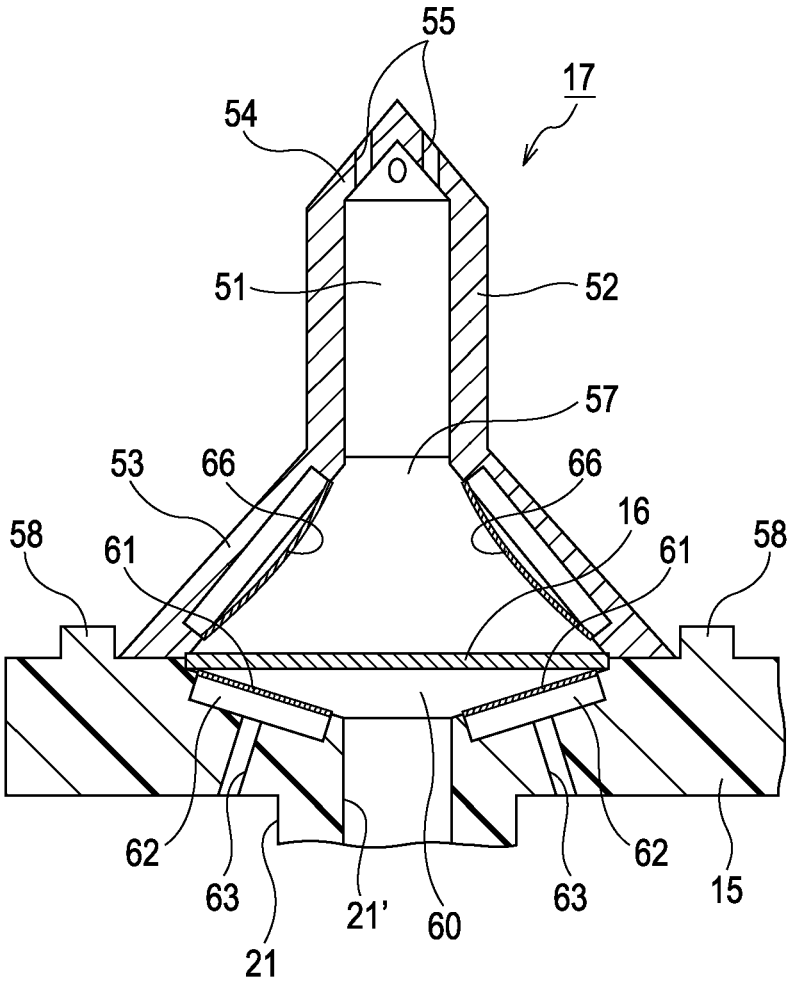
FIG. 6 is an essential sectional view showing a configuration of a second embodiment.

Moreover, as shown in a second embodiment in FIG. 6, in addition to the flexible film 61 disposed at a position downstream of the filter 16, an upstream flexible film 66 may be provided on the inner wall of the upstream filter chamber 57 at a position upstream of the filter 16. With this configuration, since the pressure changes in the recording head is absorbed by means of deformation of the flexible films 61, 66 that are disposed above and below the filter 16, it is possible to more reliably reduce adverse effects to the menisci at the nozzles 46. Further, when the flexible films 61, 66 deform during cleaning operation, thereby narrowing the flow channels, the ability to discharge air bubbles is further improved.

The invention is not limited to the printer, and can be applied to various ink jet recording apparatuses such as plotters, facsimile machines, and copy machines, and liquid ejection apparatuses other than recording apparatuses, for example, display manufacturing apparatuses, electrode manufacturing apparatuses, and chip manufacturing apparatuses as long as the liquid ejection apparatus has a configuration to introduce liquid from a liquid containing member to a liquid ejection head. That is, the display manufacturing apparatuses eject the color material solution of R (Red), G (Green) and B (Blue) from the respective color material ejection heads. The electrode manufacturing apparatuses eject an electrode material in a liquid form from the electrode material ejection head. Further, the chip manufacturing apparatuses eject a bio-organic solution from the bio-organic material ejection head.

The entire disclosure of Japanese Patent Application No. 2011-083391, filed Apr. 5, 2011 is expressly incorporated by reference herein.

What is claimed is:

1. A liquid ejection head that introduces a supplied liquid into a common liquid chamber through a filter and a liquid introduction path and generates pressure changes in a pressure chamber that communicates with the common liquid chamber by actuating a pressure generating unit, so that the liquid in the pressure chamber is ejected as liquid droplets through nozzles by using the pressure changes, comprising:

an ink introduction needle partially defining a filter chamber that is located downstream of an ink introduction needle inlet, the filter chamber being disposed at an inlet opening of the liquid introduction path and is provided with the filter disposed therein; and a flexible film that is disposed on an inner wall of the filter chamber at a position downstream of the filter, wherein the flexible film is configured to deform in accordance with pressure changes different from the pressure changes generated by the pressure generating unit in the liquid introduction path.

2. The liquid ejection head according to claim 1, wherein a cavity is formed on the inner wall of the filter chamber at a position downstream of the filter so as to be recessed away from the filter chamber, and the flexible film is formed so as to seal the opening of the cavity.

3. The liquid ejection head according to claim 2, wherein the cavity is configured to be open to the atmosphere.

4. The liquid ejection head according to claim 1, wherein an upstream flexible film is disposed on the inner wall of the filter chamber at a position upstream of the filter.

5. A liquid ejection apparatus comprising:

the liquid ejection head according to claim 1;

a sealing member that seals a nozzle forming surface of the liquid ejection head; and a suction unit that suctions a liquid out of the nozzles by generating negative pressure in a sealed cavity that is formed between the sealing member and the nozzle forming surface.

6. A liquid ejection apparatus comprising:

the liquid ejection head according to claim 2;

a sealing member that seals a nozzle forming surface of the liquid ejection head; and a suction unit that suctions a liquid out of the nozzles by generating negative pressure in a sealed cavity that is formed between the sealing member and the nozzle forming surface.

7. A liquid ejection apparatus comprising:

the liquid ejection head according to claim 3;

a sealing member that seals a nozzle forming surface of the liquid ejection head; and a suction unit that suctions a liquid out of the nozzles by generating negative pressure in a sealed cavity that is formed between the sealing member and the nozzle forming surface.

8. A liquid ejection apparatus comprising:

the liquid ejection head according to claim 4;

a sealing member that seals a nozzle forming surface of the liquid ejection head; and a suction unit that suctions a liquid out of the nozzles by generating negative pressure in a sealed cavity that is formed between the sealing member and the nozzle forming surface.

* * * * *